US010175631B2

(12) United States Patent
Sadik et al.

(10) Patent No.: US 10,175,631 B2
(45) Date of Patent: Jan. 8, 2019

(54) EARTH PLATE WITH BREAKAWAY ROTATED TABS

(71) Applicant: Xerox Corporation, Norwalk, CT (US)

(72) Inventors: Jonathan D. Sadik, Rochester, NY (US); Karl E. Kurz, Rochester, NY (US); David B. Playfair, Penfield, NY (US); Nancy L. Belknap, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 15/591,177

(22) Filed: May 10, 2017

(65) Prior Publication Data

US 2018/0329354 A1 Nov. 15, 2018

(51) Int. Cl.
*G03G 15/00* (2006.01)

(52) U.S. Cl.
CPC ..... *G03G 15/80* (2013.01)

(58) Field of Classification Search
CPC ..... G03G 15/80
USPC ..... 399/90
See application file for complete search history.

(56) References Cited

U.S. PATENT DOCUMENTS

| | | | |
|---|---|---|---|
| 3,443,257 | A | 5/1969 | Mollman |
| 4,561,763 | A | 12/1985 | Basch |
| 5,815,773 | A | 9/1998 | Zaman |
| 5,943,527 | A | 8/1999 | Kashiwagi et al. |
| 6,785,489 | B2 | 8/2004 | Anderson, II |
| 7,020,410 | B2 | 3/2006 | Zogg et al. |
| D521,455 | S | 5/2006 | Radza |
| D524,756 | S | 7/2006 | Radza |
| 7,103,297 | B2 | 9/2006 | Guy et al. |
| 7,431,306 | B2 | 10/2008 | Ueta et al. |
| 8,303,357 | B2 | 11/2012 | Kuwahara et al. |
| D681,058 | S | 4/2013 | Yamamoto et al. |
| 8,422,913 | B2 | 4/2013 | Tanaka et al. |
| 9,472,866 | B1 * | 10/2016 | Seelig ..... H01R 4/26 |
| D820,797 | S | 6/2018 | O'Connell |
| D823,262 | S | 7/2018 | Sadik et al. |

(Continued)

OTHER PUBLICATIONS

U.S. Appl. No. 29/603,468, Notice of Allowance dated Apr. 18, 2018, pp. 1-8.

(Continued)

*Primary Examiner* — Susan S Lee
(74) *Attorney, Agent, or Firm* — Gibb & Riley, LLC

(57) ABSTRACT

A ground plate includes an electrically conductive planar member having a long axis and a perpendicular short axis. The planar member has an elongated hexagonal shape having two opposing long sides, two opposing relatively shorter sides, and four angled sides between the long sides and the relatively shorter sides with a hollow central opening. Spring clips extend from inner edges of the hollow central opening. The inner edges from which the spring clips extend are parallel to the long axis. Each spring clip includes a distal end portion curving outward from the hollow central opening and is configured to contact a shaft extending through the hollow central opening to form an electrical connection between the planar member and the shaft. A tab projection extends from an outer edge of each of the relatively shorter sides. Each tab projection is in the same plane as the planar member.

20 Claims, 7 Drawing Sheets

(56) References Cited

U.S. PATENT DOCUMENTS

| | | | | |
|---|---|---|---|---|
| 2003/0194248 | A1* | 10/2003 | Anderson, II | G03G 15/751 399/90 |
| 2014/0072342 | A1 | 3/2014 | Iijima et al. | |
| 2016/0345754 | A1 | 12/2016 | Hogrefe | |

OTHER PUBLICATIONS

U.S. Appl. No. 29/603,464, Notice of Allowance dated Jul. 20, 2018, pp. 1-8.

* cited by examiner

EARTH PLATE WITH BREAKAWAY ROTATED TABS

BACKGROUND

Devices and methods herein generally relate to xerographic or electrostatographic printing machines, and more particularly to a drum unit and an earth plate used in a drum unit, which are used in image forming apparatuses, such as copying machines, laser printers, and facsimile machine.

In an image forming apparatus, for example a copying machine, an original image or document is usually read by an exposure section to form an electrostatic latent image on a photosensitive drum. A developing unit for forming toner image is disposed about an outer circumference of the photosensitive drum. The developing unit develops the read image by charging toner supplied from a toner hopper so that it has an electrostatic charge that is opposite that of the electrostatic latent image on the photosensitive drum. The toner adheres to the photosensitive drum at oppositely charged portions of the drum corresponding to the electrostatic latent image through a developing sleeve.

Electrophotographic imaging members are well known in the art. One type of photoreceptor conventionally utilized for copiers and printers and the like comprises a hollow photosensitive drum. The drum includes a tube that is obtained by forming a conductive metal into a cylindrical shape. Typically, the drum has been dip coated with various coatings including at least one photosensitive coating. These photoreceptors are usually supported on an electrically conductive shaft by drum supporting hubs or end flanges. The hubs can be constructed of metal, which is very robust to fatigue effects and deformation due to interference with the drive shaft. Hubs provide excellent stability and efficient grounding over the part life, however these parts are not cost effective. Hubs made of plastic material are lower cost and have a hole through their center into which a supporting axle shaft is inserted. That is, a flange member is forced into openings at opposing ends of the drum tube to provide the interface to a driving mechanism for rotation of the drum. Hubs constructed of metal provide a direct grounding connection to the metal substrate, while hubs constructed of electrically insulating plastic material require an electrical grounding device, which can be secured to the hub and positioned to contact both the electrically conductive axle shaft and the electrically conductive metal substrate of the photosensitive drum.

To produce a conductive state between the drum tube and the apparatus body, an electrical grounding device, sometimes referred to herein as an earth plate, may be attached to the flange member. The earth plate has an outer peripheral contact portion that is configured to contact the drum tube. An inner contact portion of the earth plate is configured to be in contact with the periphery of the shaft pin.

Earth plate devices can be constructed of various metals including, aluminum, copper, bronze, stainless steel, and the like. Material selection is key to providing a good reliable spring contact with the shaft, to be robust against corrosion in various environments, and withstand frictional stress during machine operation. Earth plate design is critical to insure mechanical performance against fatigue failure induced by vibration or misalignment of the motor drive shaft, which provide a ground path for the photoreceptor. In some cases, where misalignment is extreme or external sub-systems are pushing against the drum unit, fatigue failure can occur, which can reduce or obstruct the grounding pathway and lead to print defects or potential disruption of the electrical system of the printer. The clip on the earth plate can be overly constrained, reducing the ability of the clips to freely flex, which may result in the tabs widening over time or fracturing and breaking off completely. Any intermittent loss of contact between the earth plate and the drive shaft will result in image defects on the print.

A need exists for an earth plate that is more robust and less susceptible to fatigue failure to extend drum unit life.

SUMMARY

Typically, contact tabs in an earth plate are aligned in a transverse direction across the long axis of the earth plate. In one aspect of a device disclosed herein, the contact tabs have been rotated 90°, which puts them out of alignment with the earth plate mounting features. Previous alignment of the tabs and mounting features limits the range of flexibility of the tabs. Additionally, the grain of the metal used to make the earth plate is oriented to run perpendicular to the bend of the tabs. The geometry of the earth plate allows the toolmaker to orient the geometry in the most cost effective way and still have the metal grain run perpendicular to the tab bends.

Exemplary devices disclosed herein include a conductive photosensitive drum and a circular flange attached to an end of the conductive photosensitive drum. The circular flange has a first portion with a first diameter for protruding above a surface of the conductive photosensitive drum and a second portion with a second diameter for inserting into an inside diameter of the conductive photosensitive drum. The second diameter is relatively smaller than the first diameter. The circular flange has an aperture centrally located therein. A ground plate is mounted in the circular flange. The ground plate includes a planar member made of electrically conductive material and has a long axis and a short axis. The long axis is perpendicular to the short axis. The long axis is longer than the second diameter of the circular flange. The ground plate includes a hollow, rectangular central opening. A drive shaft extends into the conductive photosensitive drum through the aperture of the circular flange and through the hollow, rectangular central opening of the ground plate. The ground plate further includes a pair of clips extending from inner edges of the rectangular central opening. The inner edges are parallel to the long axis of the planar member. Each clip of the pair of clips is angled relative to the surface of the planar member. Each clip of the pair of clips includes a distal end portion curving outward from the hollow, rectangular central opening. Each clip of the pair of clips contacts the drive shaft and forms an electrical connection between the ground plate and the drive shaft. The ground plate further includes a pair of tab projections that extend from outer edges of the planar member. Each tab projection of the pair of tab projections is in the same plane as the planar member. The outer edges, from which the tab projections extend, are parallel to the short axis. Each tab projection of the pair of tab projections is folded over the second portion of the circular flange and forms an electrical connection between the ground plate and the conductive photosensitive drum.

Exemplary image forming devices herein include a printer engine and a photosensitive drum assembly mounted in the printer engine. The photosensitive drum assembly includes a cylindrical drum having a photosensitive layer on an outer surface thereof. The photosensitive drum assembly includes a first end cap and a second end cap. Each of the end caps is configured to fit into opposite ends of the cylindrical drum. A drive shaft extends into the cylindrical drum through the first end cap. A ground plate made of electrically conductive material is fixed to an inner face of the first end cap. The ground plate includes a planar member having a first axis and a second axis. The first axis is perpendicular to the second axis and the first axis is longer than the second axis. The planar member includes a rectangular central opening. A pair of clips extends from inner edges of the rectangular central opening. The inner edges from which the clips extend are parallel to the first axis of the planar member. Each clip of the pair of clips is approximately perpendicular relative to the surface of the planar member. Each clip of the pair of clips includes a distal end portion curving outward from the rectangular central opening. Each clip of the pair of clips contacts the drive shaft and forms an electrical connection between the ground plate and the drive shaft. A pair of tab projections extends from outer edges of the planar member. Each tab projection of the pair of tab projections is in the same plane as the planar member. The outer edges from which the tab projections extend are parallel to the second axis of the planar member. Each tab projection of the pair of tab projections is folded over a lip of the first end cap and forms an electrical connection between the ground plate and the cylindrical drum.

An exemplary ground plate herein includes an electrically conductive planar member having a first axis and a second axis. The first axis is perpendicular to the second axis and the first axis is longer than the second axis. The planar member covers an elongated hexagonal shape having two opposing long sides parallel to the first axis, two opposing relatively shorter sides parallel to the second axis, and four angled sides between the long sides and the relatively shorter sides. The angled sides are displaced at least 20° from the first axis. The electrically conductive planar member further includes a hollow central opening. Spring clips extend from inner edges of the hollow central opening of the planar member. The inner edges from which the spring clips extend are parallel to the first axis of the planar member. Each spring clip is angled relative to a surface of the planar member and each spring clip includes a distal end portion curving outward from the hollow central opening of the planar member. Each spring clip is approximately the same size and is configured to contact a shaft extending through the hollow central opening of the planar member to form an electrical connection between the planar member and the shaft. A tab projection extends from an outer edge of each of the relatively shorter sides of the planar member. Each tab projection is in the same plane as the planar member. The outer edge from which the tab extends is parallel to the second axis of the planar member.

These and other features are described in, or are apparent from, the following detailed description.

BRIEF DESCRIPTION OF THE DRAWINGS

Various examples of the devices and methods are described in detail below, with reference to the attached drawing figures, which are not necessarily drawn to scale and in which.

DETAILED DESCRIPTION

Figure 1:
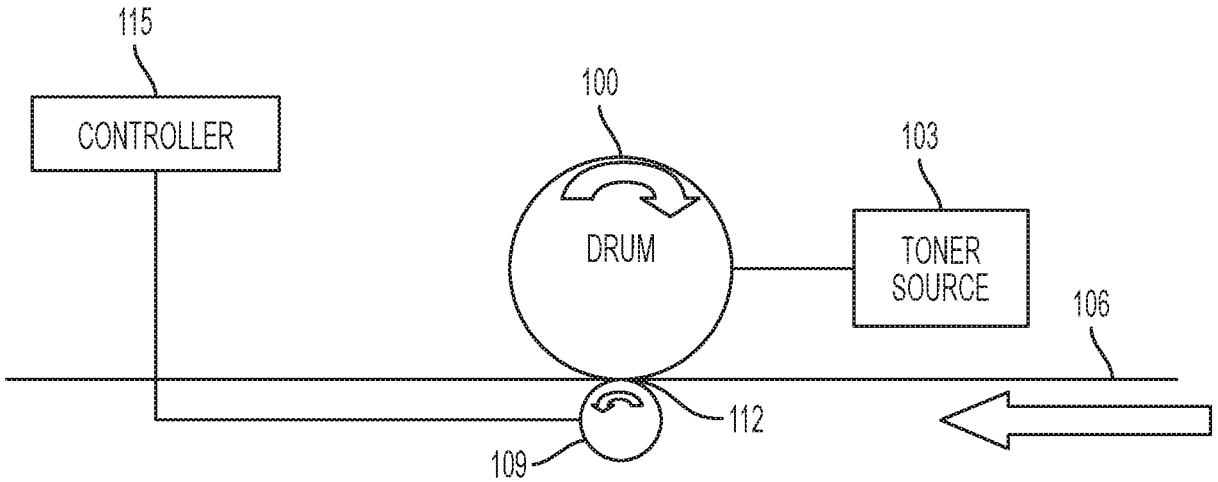
FIG. 1 is a schematic diagram of an electrostatic imaging system according to devices and methods herein.

The disclosure will now be described by reference to a multi-function device that includes an automatic document handler. While the disclosure will be described hereinafter in connection with specific devices and methods thereof, it will be understood that limiting the disclosure to such specific devices and methods is not intended. On the contrary, it is intended to cover all alternatives, modifications, and equivalents as may be included within the spirit and scope of the disclosure as defined by the appended claims.

For a general understanding of the features of the disclosure, reference is made to the drawings. In the drawings, like reference numerals have been used throughout to identify identical elements.

Referring to FIG. 1, a simple electrostatic imaging system is shown, which can be used with devices and methods herein and can comprise, for example, a printer, copier, fax machine, multi-function device (MFD), etc. An electronic or optical image or an image of an original document or set of documents to be reproduced may be projected or scanned onto a charged surface of a photoreceptor drum 100 to form an electrostatic latent image. The latent image is developed with developing material from a toner source 103 to form a toner image corresponding to the latent image. More specifically, a sheet of print media is fed from a selected media sheet tray having a supply of paper to a sheet transport for travel to a transfer station including the photoreceptor drum 100. There, the toned image is electrostatically transferred to the print media. In other words, a surface, such as a printing medium 106, is moved adjacent to (and/or in contact with) the photoreceptor drum 100 and toner is transferred to the printing medium 106 with the assistance of a charged transfer device 109. That is, by operation of the charge induced into the printing medium 106 by the charged transfer device 109, oppositely charged toner is attracted from the photoreceptor drum 100 to the printing medium 106 as the printing medium 106 passes through the nip 112 created between the photoreceptor drum 100 and the charged transfer device 109. The toner remains on the printing medium 106 after it passes through the nip 112, and is fused to the printing medium 106. A controller 115 is connected to the charged transfer device 109 to control operation of the electrostatic imaging system while varying the transfer field of the charged transfer device 109.

As would be understood by those ordinarily skilled in the art, the electrostatic imaging system shown in FIG. 1 is only one example and the devices and methods herein are equally applicable to other types of printing devices that may include fewer components or more components. For example, while a single photoreceptor drum 100 and paper path are illustrated in FIG. 1, those ordinarily skilled in the art would understand that many more paper paths and additional photoreceptor drums 100 could be included within any printing device used with devices and methods herein.

In other words, an exemplary imaging system comprises a multifunctional device with print, copy, scan, and fax services. Such multifunctional devices are well known in the art and may comprise print engines based upon liquid or solid ink jet, electrophotography, other electrostatographic technologies, and other imaging technologies. The general principles of electrophotographic imaging are well known to many skilled in the art and are described above as an example of an imaging system to which the present concepts is applicable.

It should be understood that the controller 115 as used herein may comprise a computerized device adapted to perform (i.e., programmed to perform, configured to perform, etc.) the below described system operations. According to devices and methods herein, the controller 115 comprises a programmable, self-contained, dedicated mini-computer having a central processor unit (CPU). Computerized devices that include chip-based central processing units (CPU's) are well-known and readily available devices produced by manufacturers such as Dell Computers, Round Rock Tex., USA, and Apple Computer Co., Cupertino Calif., USA. The details of such computerized devices are not discussed herein for purposes of brevity and reader focus.

Figure 2:
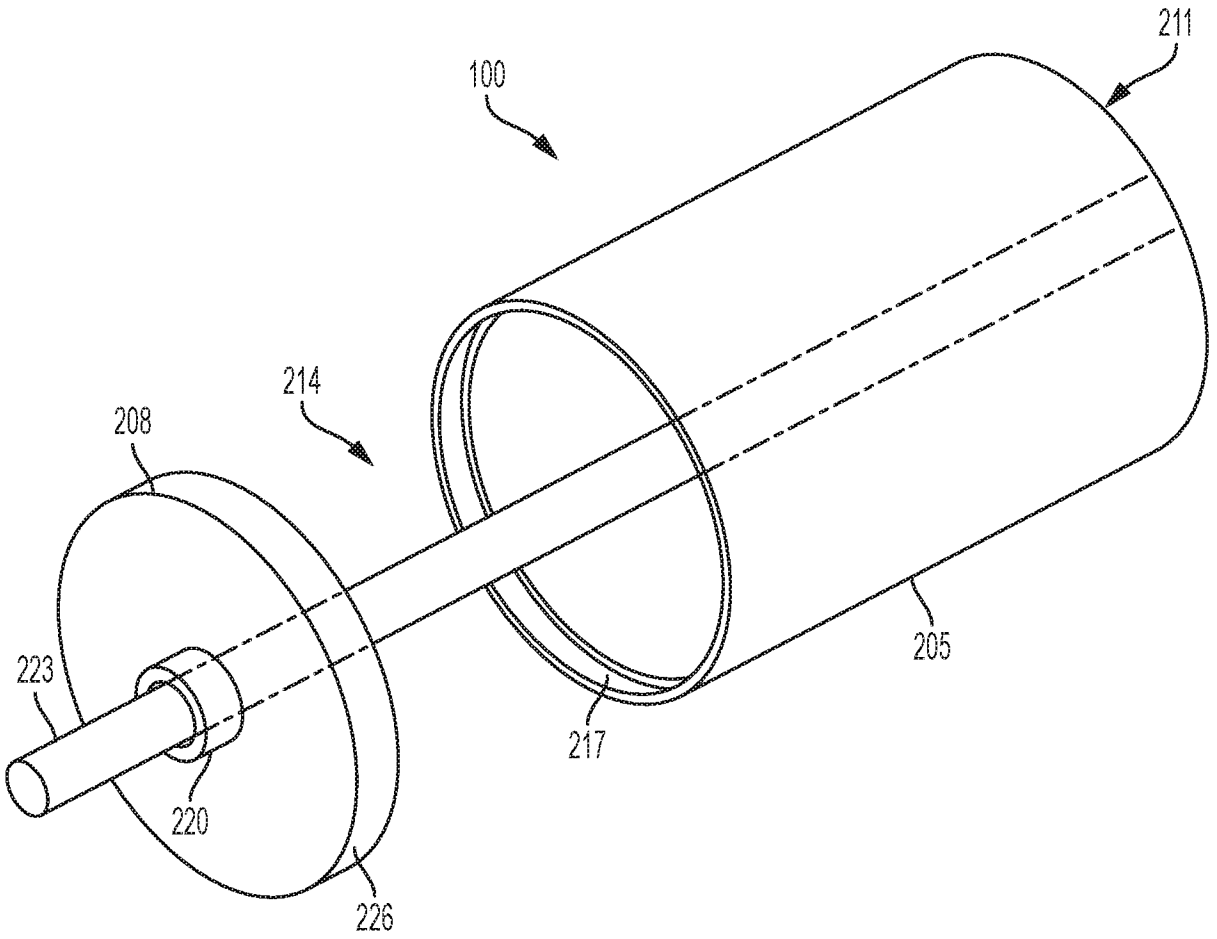
FIG. 2 is a perspective view of a typical photoreceptor drum.

FIG. 2 shows a photoreceptor drum 100, on the surface of which an electrostatic latent image is formed. The photoreceptor drum 100 has a photosensitive drum tube 205 and flanges 208, 211. The photosensitive drum tube 205 is obtained by forming a conductive metal into a cylindrical shape. The photosensitive drum tube 205 can have a photosensitive layer, for example an organic photoconductor (OPC), formed on the peripheral surface of the metal tube. Openings, such as 214, are formed on the ends of the photosensitive drum tube 205, and fittings, such as 217, having a specific length and a smaller wall thickness are provided on the ends of the openings 214. In the center of the flange 208, an aperture or support hole 220 is provided. The support hole 220 is fitted with a drive shaft 223 in order to support and rotate the photosensitive drum tube 205. The peripheral surface of the flange 208 defines a contact portion 226 that is inserted in the fitting 217 of the photosensitive drum tube 205.

Figure 3A:
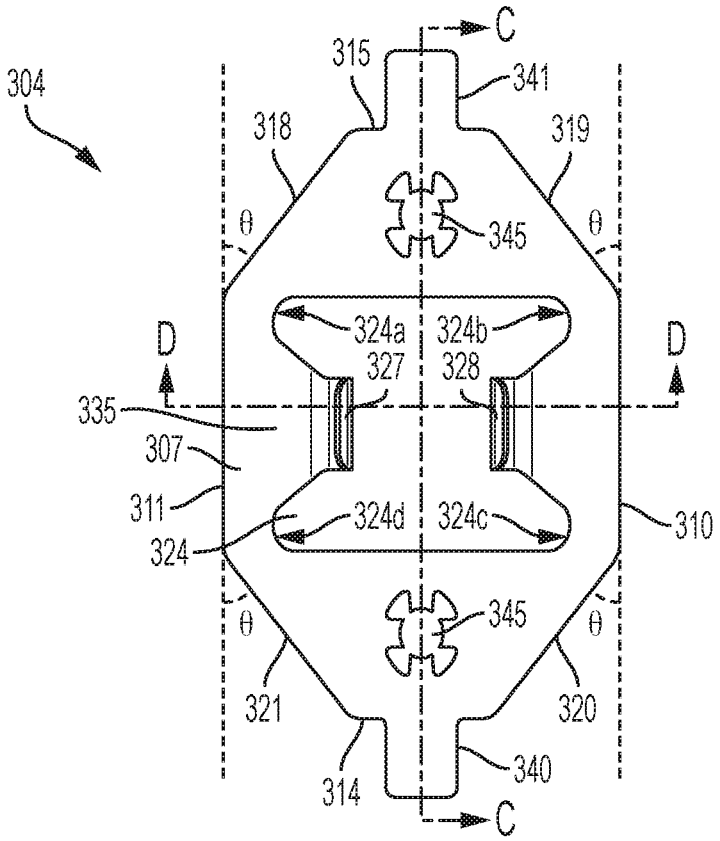
FIG. 3A is a top view of an earth plate, according to devices and methods herein.
Figure 3B:
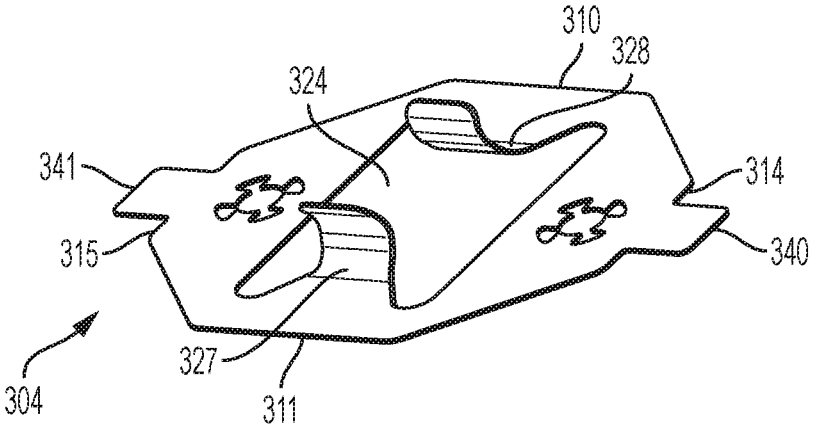
FIG. 3B is a perspective view of the earth plate of FIG. 3A, according to devices and methods herein.
Figure 3C:
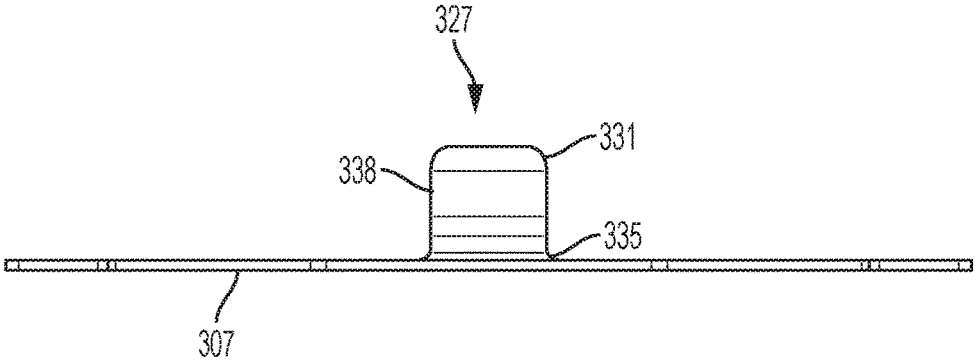
FIG. 3C is a side view of the earth plate taken along line C-C of FIG. 3A.
Figure 3D:
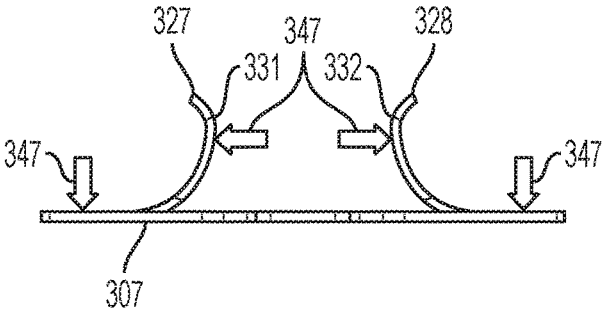
FIG. 3D is an end view of the earth plate taken along line D-D of FIG. 3A.

FIGS. 3A-3D show various views of an earth plate, indicated generally as 304, according to the present disclosure. The earth plate 304 comprises a planar member 307 that is made of an electrically conductive material. For example, in the some cases, the planar member 307 can be made of copper, aluminum, titanium, stainless steel, phosphor bronze, or other appropriate metal. The planar member 307 has a first axis along the length of line C-C in FIG. 3A and a second axis along the length of line D-D in FIG. 3A. The first axis is perpendicular to the second axis and the first axis is longer than the second axis. As shown in FIG. 3A, the planar member 307 comprises an elongated hexagonal shape having two opposing long sides 310, 311 parallel to the first axis. The planar member 307 has two opposing short sides 314, 315 parallel to the second axis. The planar member 307 also has four angled sides 318, 319, 320, 321 between the long sides 310, 311 and the short sides 314, 315. Due to the elongated hexagonal shape of the planar member 307, the angled sides 318, 319, 320, 321 are angled from the first axis at an angle Ø that is displaced at least 20°.

The planar member 307 includes a central opening 324 that is hollow. As shown in FIG. 3A, the central opening 324 is rectangularly shaped. Spring clips 327, 328 extend from inner edges of the central opening 324. The inner edges from which the spring clips 327, 328 extend are parallel to the first axis. Each spring clip 327, 328 is angled relative to a surface of the planar member 307 and includes a distal end portion 331, 332 that curves outward from the central opening 324, best seen in FIG. 3D. Each of the spring clips 327, 328 is approximately the same size and configured to contact the drive shaft 223 extending through the central opening 324 of the planar member 307. The spring clips 327, 328 press against and form an electrical connection between the earth plate 304 and the drive shaft 223. The base 335 of the spring clips 327, 328 is wider than the top 338, giving the spring clips 327, 328 a substantially trapezoidal shape. This improves flexibility and fatigue strength of the spring clips 327, 328.

Figure 5:
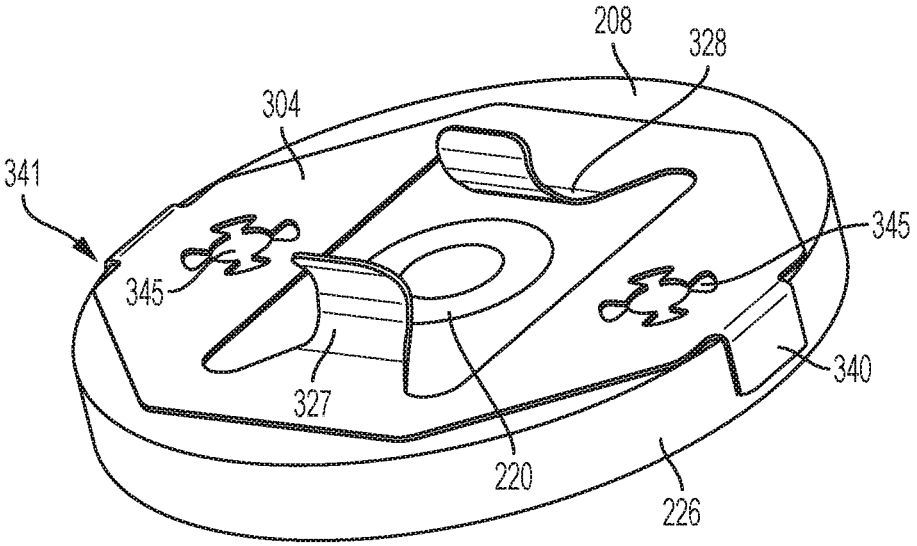
FIG. 5 is a perspective view of a hub flange with an earth plate, according to devices and methods herein.

Tab projections 340, 341 extend from an outer edge of each of the short sides 314, 315 of the planar member 307. Each tab projection 340, 341 is in the same plane as the planar member 307. The earth plate 304 includes mounting devices, such as 345, to attach the earth plate 304 to the flange 208. As shown in FIG. 5, each tab projection 340, 341 is then folded over the contact portion 226 of the flange 208 so that it forms an electrical connection between the earth plate 304 and the photoreceptor drum 100. The flange 208 and the drive shaft 223 are intended to move together so there should be no relative motion between the drive shaft 223 and the earth plate 304. The spring clips 327, 328 are in contact with the drive shaft 223 and provide a path for grounding of the photoreceptor drum 100.

In forming the earth plate 304, the direction of the grain of the material used in the planar member 307 should be oriented perpendicular to the first axis, which is the long axis of the planar member 307. Note, when installed, the entire earth plate 304, not just the spring clip 327, 328, flexes around the first axis, in the direction indicated by block arrows 347. This flexure enables the stress to be distributed throughout the earth plate 304, without breaking the spring clip 327, 328. The highest concentration of stress is at the corners of the central opening, indicated as 324*a-d*. In other words, the clips do not flex at the defined bend region making the earth plate 304 more robust to breakage and clip deformation.

Figure 4A:
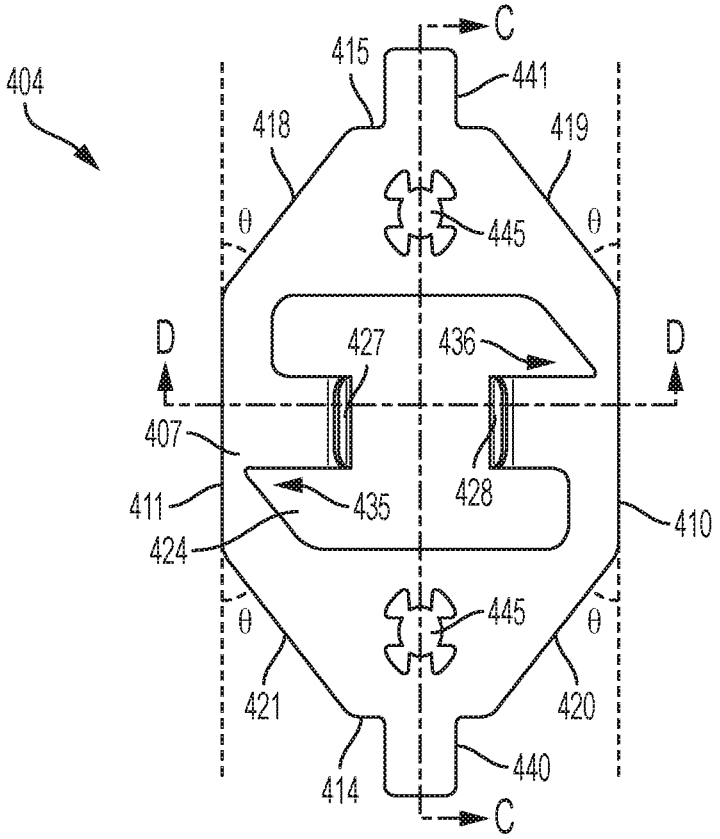
FIG. 4A is a top view of an earth plate, according to devices and methods herein.
Figure 4B:
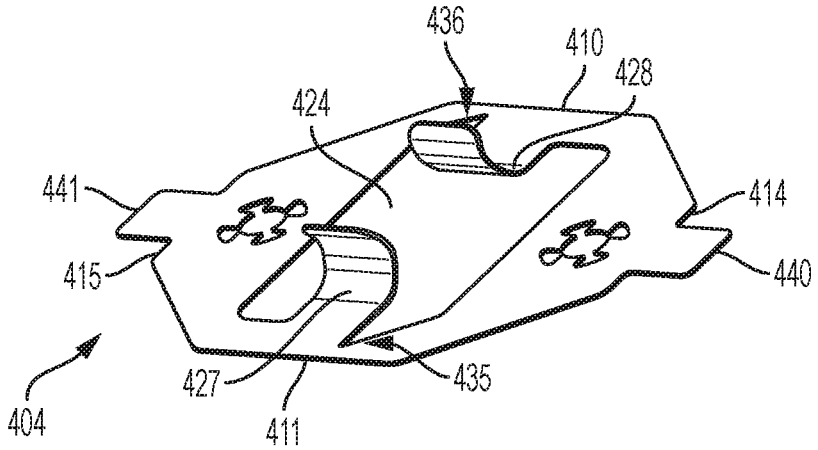
FIG. 4B is a perspective view of the earth plate of FIG. 4A, according to devices and methods herein.
Figure 4C:
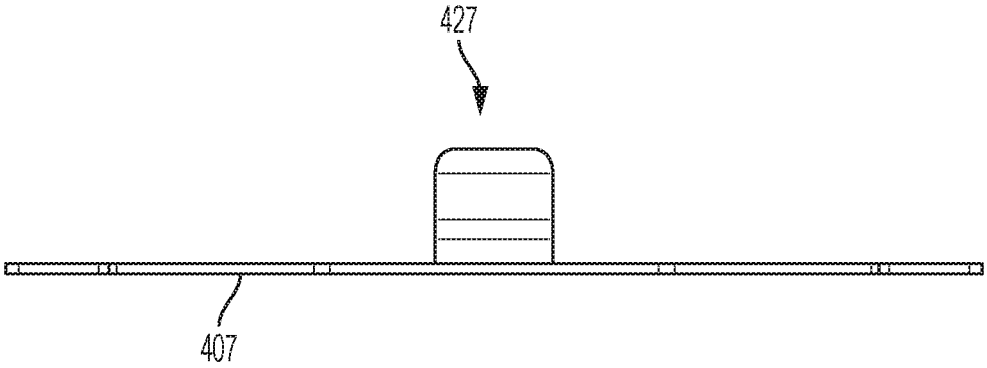
FIG. 4C is a side view of the earth plate taken along line C-C of FIG. 4A.
Figure 4D:
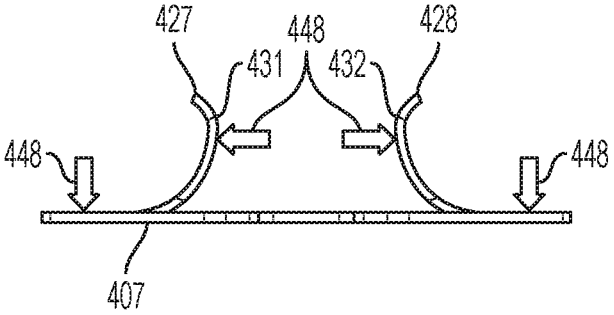
FIG. 4D is an end view of the earth plate taken along line D-D of FIG. 4A.

FIGS. 4A-4D show various views of an earth plate, indicated generally as 404, according to the present disclosure. The earth plate 404 comprises a planar member 407 that is made of an electrically conductive material. For example, in the some cases, the planar member 407 can be made of stainless steel, phosphor bronze, or other appropriate metal. The planar member 407 has a first axis along the length of line C-C in FIG. 4A and a second axis along the length of line D-D in FIG. 4A. The first axis is perpendicular to the second axis and the first axis is longer than the second axis. As shown in FIG. 4A, the planar member 407 comprises an elongated hexagonal shape having two opposing long sides 410, 411 parallel to the first axis. The planar member 407 has two opposing short sides 414, 415 parallel to the second axis. The planar member 407 also has four angled sides 418, 419, 420, 421 between the long sides 410, 411 and the short sides 414, 415. Due to the elongated hexagonal shape of the planar member 407, the angled sides 418, 419, 420, 421 are angled from the first axis at an angle θ that is displaced at least 20°.

The planar member 407 includes a central opening 424 that is hollow. As shown in FIG. 4A, the central opening 424 is approximately rectangular shaped. Spring clips 427, 428 extend from inner edges of the central opening 424. The inner edges from which the spring clips 427, 428 extend are parallel to the first axis. Each spring clip 427, 428 is angled relative to a surface of the planar member 407 and includes a distal end portion 431, 432 that curves outward from the central opening 424, best seen in FIG. 4D. Each of the spring clips 427, 428 is approximately the same size and configured to contact the drive shaft 223 extending through the central opening 424 of the planar member 407. The spring clips 427, 428 press against and form an electrical connection between the earth plate 404 and the drive shaft 223. As shown in FIG. 4A, the inner edges of the central opening 424 include a cutout portion adjacent to each of the spring clips 427, 428. The cutout produces a sharp inside corner 435, 436 near where the spring clips 427, 428 extend from the inner edge. This provides a portion of the planar member 407 that can be allowed to break under cyclic loading without breaking off the spring clips 427, 428. Note, when installed, the entire earth plate 404, not just the spring clip 427, 428, flexes around the first axis, in the direction indicated by block arrows 448. This flexure enables the stress to be distributed throughout the earth plate 404, without breaking the spring clip 427, 428.

Tab projections 440, 441 extend from an outer edge of each of the short sides 414, 415 of the planar member 407. Each tab projection 440, 441 is in the same plane as the planar member 407. The earth plate 404 includes mounting devices, such as 445, to attach the earth plate 404 to the flange 208. As shown in FIG. 5, each tab projection 440, 441 is then folded over the contact portion 323 of the flange 208 so that it forms an electrical connection between the earth plate 404 and the photoreceptor drum 100. The flange 208 and the drive shaft 223 are intended to move together so there should be no relative motion between the drive shaft 223 and the earth plate 404. The spring clips 427, 438 are in contact with the drive shaft 223 and provide a path for grounding of the photoreceptor drum 100.

In forming the earth plate 404, the direction of the grain of the material used in the planar member 407 should be oriented perpendicular to the first axis, which is the long axis of the planar member 407.

Note, in general, all the corners on earth plate 304 or 404 may be rounded to minimize area of stress concentration. Therefore, the earth plate 304 or 404 disclosed herein provides increased robustness to drive shaft vibration or wobble, because it allows the earth plate 304 or 404 to flex under pressure, reducing the chance of breakage. In addition, the specific geometry for the earth plate 304 or 404 employs intentionally engineered weak/failure points to prevent more random and catastrophic fatigue failures.

While some exemplary structures are illustrated in the attached drawings, those ordinarily skilled in the art would understand that the drawings are simplified schematic illustrations and that the claims presented below encompass many more features that are not illustrated (or potentially many less) but that are commonly utilized with such devices and systems. Therefore, it is not intended for the claims presented below to be limited by the attached drawings, but instead the attached drawings are merely provided to illustrate a few ways in which the claimed features can be implemented.

Many computerized devices are discussed above. Computerized devices that include chip-based central processing units (CPU's), input/output devices (including graphic user interfaces (GUI), memories, comparators, processors, etc. are well-known and readily available devices produced by manufacturers such as Dell Computers, Round Rock Tex., USA and Apple Computer Co., Cupertino Calif., USA. Such computerized devices commonly include input/output devices, power supplies, processors, electronic storage memories, wiring, etc., the details of which are omitted herefrom to allow the reader to focus on the salient aspects of the embodiments described herein. Similarly, scanners and other similar peripheral equipment are available from Xerox Corporation, Norwalk, Conn., USA and the details of such devices are not discussed herein for purposes of brevity and reader focus.

The terms printer or printing device as used herein encompasses any apparatus, such as a digital copier, bookmaking machine, facsimile machine, multi-function machine, etc., which performs a print outputting function for any purpose. The details of printers, printing engines, etc., are well known by those ordinarily skilled in the art and are not described in detail herein to keep this disclosure focused on the salient features presented. The devices and methods herein can encompass devices that print in color, monochrome, or handle color or monochrome image data. All foregoing devices and methods are specifically applicable to electrostatographic and/or xerographic machines and/or processes.

The terminology used herein is for the purpose of describing particular devices and methods only and is not intended to be limiting of this disclosure. As used herein, the singular forms "a", "an", and "the" are intended to include the plural forms as well, unless the context clearly indicates otherwise. It will be further understood that the terms "comprises", "comprising", "includes", and/or "including", when used in this specification, specify the presence of stated features, integers, steps, operations, elements, and/or components, but do not preclude the presence or addition of one or more other features, integers, steps, operations, elements, components, and/or groups thereof.

In addition, terms such as "right", "left", "vertical", "horizontal", "top", "bottom", "upper", "lower", "under", "below", "underlying", "over", "overlying", "parallel", "perpendicular", etc., used herein, are understood to be relative locations as they are oriented and illustrated in the drawings (unless otherwise indicated). Terms such as "touching", "on", "in direct contact", "abutting", "directly adjacent to", etc., mean that at least one element physically contacts another element (without other elements separating the described elements). Further, the terms "automated" or "automatically" mean that once a process is started (by a machine or a user), one or more machines perform the process without further input from any user.

The corresponding structures, materials, acts, and equivalents of all means or step plus function elements in the claims below are intended to include any structure, material, or act for performing the function in combination with other claimed elements as specifically claimed. The descriptions of the various devices and methods of the present disclosure have been presented for purposes of illustration, but are not intended to be exhaustive or limited to the devices and methods disclosed. Many modifications and variations will be apparent to those of ordinary skill in the art without departing from the scope and spirit of the described devices and methods. The terminology used herein was chosen to best explain the principles of the devices and methods, the practical application or technical improvement over technologies found in the marketplace, or to enable others of ordinary skill in the art to understand the devices and methods disclosed herein.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. Unless specifically defined in a specific claim itself, steps or components of the devices and methods herein cannot be implied or imported from any above example as limitations to any particular order, number, position, size, shape, angle, color, or material.

What is claimed is:

1. A device, comprising:

a conductive photosensitive drum;

a circular flange including a first portion having a first diameter for protruding above a surface of said conductive photosensitive drum and a second portion having a second diameter for inserting into an inside diameter of said conductive photosensitive drum, said second diameter being relatively smaller than said first diameter, said circular flange having an aperture centrally located therein;

a ground plate comprising an electrically conductive material mounted in said circular flange, said ground plate comprising a planar member having a long axis and a short axis, said long axis being perpendicular to said short axis, and said long axis being longer than said second diameter of said circular flange, said ground plate including a hollow, rectangular central opening; and a drive shaft extending into said conductive photosensitive drum through said aperture of said circular flange and through said hollow, rectangular central opening of said ground plate, said ground plate further comprising a pair of clips extending from inner edges of said hollow, rectangular central opening, said inner edges being parallel to said long axis of said planar member, each clip of said pair of clips being angled relative to the surface of said planar member, and each clip of said pair of clips including a distal end portion curving outward from said hollow, rectangular central opening, each clip of said pair of clips contacting said drive shaft and forming an electrical connection between said ground plate and said drive shaft, and said ground plate further comprising a pair of tab projections extending from outer edges of said planar member, each tab projection of said pair of tab projections being in the same plane as said planar member, said outer edges being parallel to said short axis of said planar member, each tab projection of said pair of tab projections being folded over said second portion of said circular flange and forming an electrical connection between said ground plate and said conductive photosensitive drum.

2. The device according to claim 1, wherein said planar member flexes in a direction opposite the curve of said pair of clips and stress induced by the flexure of said planar member is distributed throughout said planar member.

3. The device according to claim 1, each clip of said pair of clips comprising a spring clip.

4. The device according to claim 1, wherein each clip of said pair of clips has a base and a top, said base being wider than said top, forming a trapezoidal shape.

5. The device according to claim 1, said ground plate further comprising:

a cutout portion adjacent to each of said clips, said cutout portion producing a sharp inside corner of said hollow, rectangular central opening, said sharp inside corner being adjacent the location where said clips extend from said inner edge.

6. The device according to claim 1, said ground plate comprising an elongated hexagonal shape comprising:

two opposing long sides parallel to said long axis;

two opposing short sides parallel to said short axis; and four angled sides between said opposing long sides and said opposing short sides.

7. The device according to claim 1, wherein said electrically conductive material used in said planar member comprises a grain oriented perpendicular to said long axis of said planar member.

8. An image forming device, comprising:

a printer engine; and a photosensitive drum assembly mounted in said printer engine, said photosensitive drum assembly comprising:

a cylindrical drum having a photosensitive layer on an outer surface thereof;

a first end cap and a second end cap, each of said end caps being configured to fit into opposite ends of said cylindrical drum;

a drive shaft extending into said cylindrical drum through said first end cap; and a ground plate comprising an electrically conductive material fixed to an inner face of said first end cap, said ground plate comprising:

a planar member having a first axis and a second axis, said first axis being perpendicular to said second axis and said first axis being longer than said second axis, said planar member including a rectangular central opening, a pair of clips extending from inner edges of said rectangular central opening, said inner edges being parallel to said first axis of said planar member, each clip of said pair of clips being angled relative to the surface of said planar member, and each clip of said pair of clips including a distal end portion curving outward from said rectangular central opening, each clip of said pair of clips contacting said drive shaft and forming an electrical connection between said ground plate and said drive shaft, and a pair of tab projections extending from outer edges of said planar member, each tab projection of said pair of tab projections being in the same plane as said planar member, said outer edges being parallel to said second axis of said planar member, each tab projection of said pair of tab projections being folded over a lip of said first end cap and forming an electrical connection between said ground plate and said cylindrical drum.

9. The image forming device according to claim 8, wherein said planar member flexes in a direction opposite the curve of said pair of clips and stress induced by the flexure of said planar member is distributed throughout said planar member.

10. The image forming device according to claim 8, each clip of said pair of clips comprising a spring clip.

11. The image forming device according to claim 8, wherein each clip of said pair of clips has a base and a top, said base being wider than said top, forming a trapezoidal shape.

12. The image forming device according to claim 8, said planar member further comprising:

a cutout portion adjacent to each clip of said pair of clips, said cutout portion producing a sharp inside corner of said rectangular central opening, said sharp inside corner being adjacent the location where each said clip extends from said inner edge.

13. The image forming device according to claim 8, said planar member comprising an elongated hexagonal shape comprising:

two opposing long sides parallel to said first axis;

two opposing short sides parallel to said second axis; and four angled sides between said opposing long sides and said opposing short sides.

14. The image forming device according to claim 8, wherein said electrically conductive material used in said planar member comprises a grain oriented perpendicular to said long axis of said planar member.

15. A ground plate, comprising:

an electrically conductive planar member, said electrically conductive planar member having a long axis and a short axis relative to said long axis, said long axis being perpendicular to said short axis, said electrically conductive planar member comprising an elongated hexagonal shape having two opposing long sides parallel to said long axis, two opposing relatively shorter sides parallel to said short axis, and four angled sides between said opposing long sides and said opposing relatively shorter sides, said angled sides being displaced at least 20° from said long axis, said electrically conductive planar member further including a hollow central opening;

spring clips extending from inner edges of said hollow central opening of said electrically conductive planar member, said inner edges from which said spring clips extend being parallel to said long axis of said electrically conductive planar member, each spring clip being angled relative to a surface of said electrically conductive planar member, and each spring clip including a distal end portion curving outward from said hollow central opening, each of said spring clips being approximately the same size and configured to contact a shaft extending through said hollow central opening of said electrically conductive planar member and forming an electrical connection between said electrically conductive planar member and said shaft; and a tab projection extending from an outer edge of each of said relatively shorter sides of said electrically conductive planar member, each tab projection being in the same plane as said electrically conductive planar member, each said outer edge being parallel to said short axis of said electrically conductive planar member.

16. The ground plate according to claim 15, wherein said electrically conductive planar member flexes in a direction opposite the curve of said spring clips and stress induced by the flexure of said electrically conductive planar member is distributed throughout said electrically conductive planar member.

17. The ground plate according to claim 15, wherein each of said spring clips has a base and a top, said base being wider than said top, forming a trapezoidal shape.

18. The ground plate according to claim 15, said electrically conductive planar member further comprising:

a cutout portion adjacent to each of said spring clips, said cutout portion producing a sharp inside corner of said hollow central opening, said sharp inside corner being adjacent the location where said spring clips extend from said inner edge of said hollow central opening.

19. The ground plate according to claim 15, said electrically conductive planar member further comprising:

mounting devices configured to attach said electrically conductive planar member to a flange supporting said shaft.

20. The ground plate according to claim 15, wherein material used in said electrically conductive planar member comprises a grain oriented perpendicular to said long axis of said electrically conductive planar member.

* * * * *